US008605131B2

(12) United States Patent
Ohyama

(10) Patent No.: US 8,605,131 B2
(45) Date of Patent: Dec. 10, 2013

(54) IMAGE FORMING APPARATUS AND IMAGE FORMING METHOD

(71) Applicant: Tatsuo Ohyama, Kanagawa (JP)

(72) Inventor: Tatsuo Ohyama, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/675,845

(22) Filed: Nov. 13, 2012

(65) Prior Publication Data

US 2013/0127975 A1 May 23, 2013

Related U.S. Application Data

(62) Division of application No. 12/726,894, filed on Mar. 18, 2010, now abandoned.

(30) Foreign Application Priority Data

Mar. 18, 2009 (JP) ..... 2009-067125
Mar. 15, 2010 (JP) ..... 2010-058494

(51) Int. Cl.
*B41J 2/435* (2006.01)
*B41J 2/47* (2006.01)

(52) U.S. Cl.
USPC ..... 347/237; 347/247

(58) Field of Classification Search
USPC ..... 347/236, 237, 240, 246, 247, 251–254
See application file for complete search history.

(56) References Cited

U.S. PATENT DOCUMENTS

| | | | |
|---|---|---|---|
| 4,813,046 | A | 3/1989 | Shimada |
| 7,746,370 | B2 | 6/2010 | Hata et al. |
| 2002/0159107 | A1 | 10/2002 | Maruta et al. |
| 2005/0190254 | A1 | 9/2005 | Mori et al. |
| 2005/0206964 | A1 | 9/2005 | Hata et al. |
| 2007/0291101 | A1 | 12/2007 | Hata et al. |
| 2011/0063680 | A1 | 3/2011 | Ohyama |

FOREIGN PATENT DOCUMENTS

| | | | |
|---|---|---|---|
| EP | 1 251 684 | A1 | 10/2002 |
| JP | 06098104 | A | 4/1994 |
| JP | 2002/172817 | | 6/2002 |

OTHER PUBLICATIONS

Extended European Search Report issued Mar. 25, 2011, in Application No./Patent No. 10156746.9-1240/2230565.

*Primary Examiner* — Hai C Pham
(74) *Attorney, Agent, or Firm* — Oblon, Spivak, McClelland, Maier & Neustadt, L.L.P.

(57) ABSTRACT

An image forming apparatus that performs a shading correction includes a light source that emits a light beam; a light-source drive unit that drives the light source; and a light-quantity-adjustment-amount control unit that performs an adjustment of a light quantity in accordance with a shading correction curve by controlling, for the light-source drive unit, a light-quantity adjustment amount and an increase/decrease cycle of the light-quantity adjustment amount. The increase/decrease cycle is a unit of time within a time period during which the light-quantity adjustment amount increases or, decreases.

7 Claims, 9 Drawing Sheets

IMAGE FORMING APPARATUS AND IMAGE FORMING METHOD

CROSS-REFERENCE TO RELATED APPLICATIONS

The present application is a divisional of U.S. application Ser. No. 12/726,894 filed Mar. 18, 2010, the entire content of which is incorporated herein by reference. U.S. application Ser. No. 12/726,894 claims priority to and incorporates by reference the entire contents of Japanese Patent Application No. 2009-067125 filed in Japan on Mar. 18, 2009 and Japanese Patent Application No. 2010-058494 filed in Japan on Mar. 15, 2010.

BACKGROUND OF THE INVENTION

1. Field of the Invention

The present invention relates to an image forming apparatus and an image forming method.

2. Description of the Related Art

In an image forming apparatus, a quantity of light on an exposed surface is affected by characteristics of a deflecting element, which deflects light beam, and a lens, so even when a light source emits light beam at a constant light quantity, the light beam onto the exposed surface is not constant in light quantity. Consequently, there is a variation in an electrostatic latent image on a recording medium, and a developed image is lacking in uniformity, which shows up as perceived banding on a finally-formed image, whereby an image quality is affected.

In a conventional image forming apparatus, an image quality is improved with use of an optical element, for example, by using a lens having a characteristic capable of preventing a light quantity on the exposed surface from varying or by placing a filter on an optical path. In addition, a shading correction is performed by performing pulse-width modulation or phase modulation of a drive voltage of a light-source drive element (for example, see Japanese Patent Application Laid-open No. 2002-172817).

However, in a method for improving an image quality with use of an optical element, it is hard to adapt a temporal change due to degradation of the optical element and the like.

Furthermore, in a case of a shading correction, correction characteristics represents a continuous correction curve in accordance with optical characteristics of a lens and the like as shown in FIG. 11, so if the shading correction is performed by the pulse-width modulation of a drive voltage of a light-source drive element, the number of gradations has to be increased, and in a configuration of an apparatus, for example, it brings an excessive increase in Look Up Table (LUT) or an excessive increase in circuit size for high-speed processing and the like.

Moreover, if the number of gradations is small, the correction curve is not smooth and has steps as shown in FIG. 12, which contributes to an uneven image around the steps, and furthermore, it is necessary to provide a filter element on the outside, and the apparatus configuration increases excessively.

Furthermore, when the shading correction is performed by the phase modulation, in the same manner as the pulse-width modulation, if the number of gradations increases, there is a problem of an excessive increase in circuit size.

SUMMARY OF THE INVENTION

It is an object of the present invention to at least partially solve the problems in the conventional technology.

According to an aspect of the present invention, there is provided an image forming apparatus that performs a shading correction includes a light source that emits a light beam; a light-source drive unit that drives the light source; and a light-quantity-adjustment-amount control unit that performs an adjustment of a light quantity in accordance with a shading correction curve by controlling, for the light-source drive unit, a light-quantity adjustment amount and an increase/decrease cycle of the light-quantity adjustment amount. The increase/decrease cycle is a unit of time within a time period during which the light-quantity adjustment amount increases or decreases.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of an image forming apparatus and an image forming method according to the present invention are explained in detail below with reference to the accompanying drawings. However, the present invention is not limited to these embodiments.

First Embodiment

Figure 1:
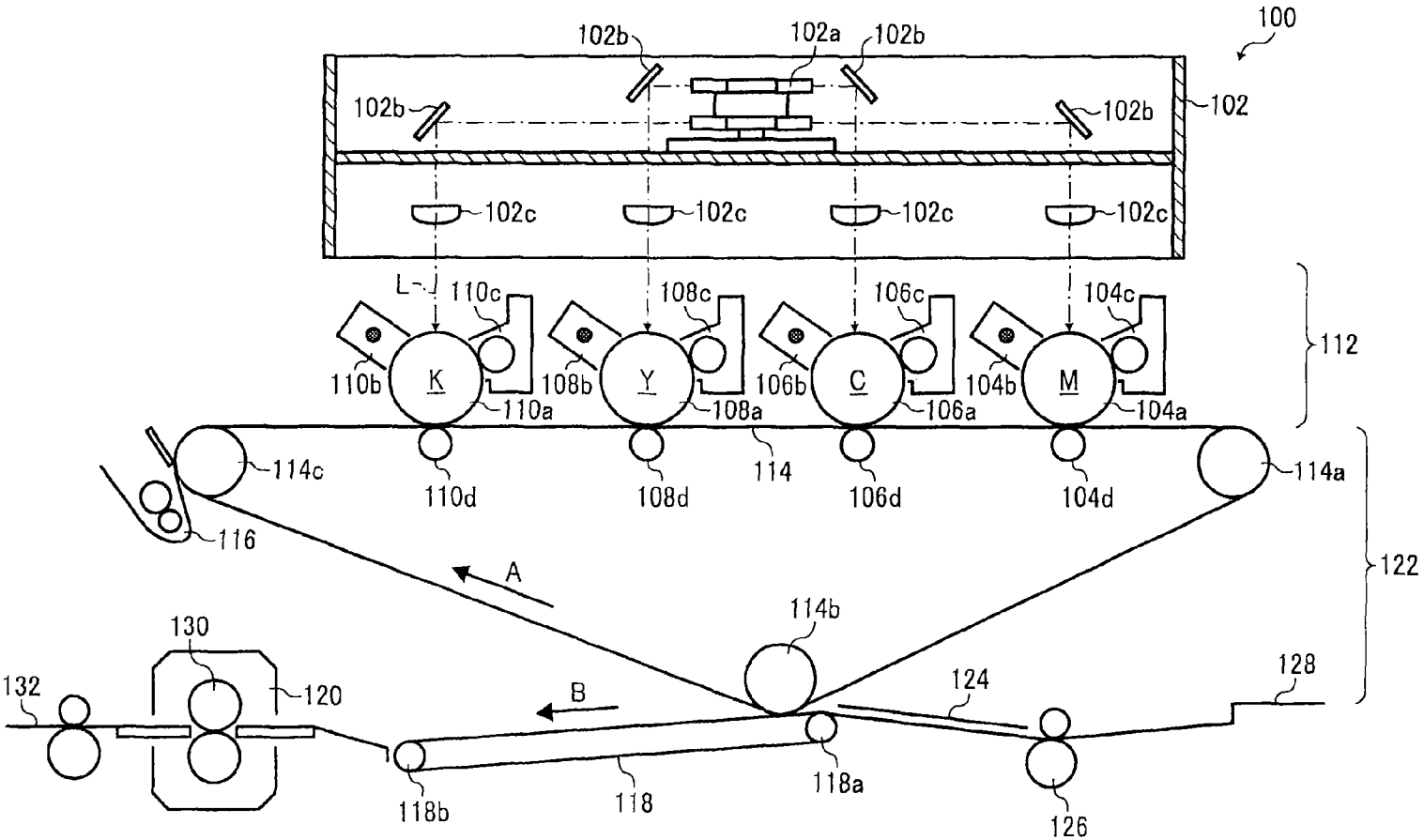
FIG. 1 is a diagram illustrating an embodiment of an image forming apparatus.

FIG. 1 is a schematic diagram illustrating a mechanical configuration of an image forming apparatus according to a first embodiment. An image forming apparatus 100 according to the present embodiment is composed of an optical device 102 including optical elements, such as a VCSEL 200 (see FIGS. 2A, 2B, and 3) and a polygon mirror 102*a*, an image forming unit 112 including photosensitive drums, charging devices, developing devices, and the like, and a transfer unit 122 including an intermediate transfer belt. The optical device 102 includes the VCSEL 200 as a semiconductor laser. In the embodiment shown in FIG. 1, light beams emitted from the VCSEL 200 (not shown in FIG. 1) are first collected by a first cylindrical lens (not shown), and deflected to respective reflection mirrors 102*b* by the polygon mirror 102*a*.

Figure 2A:
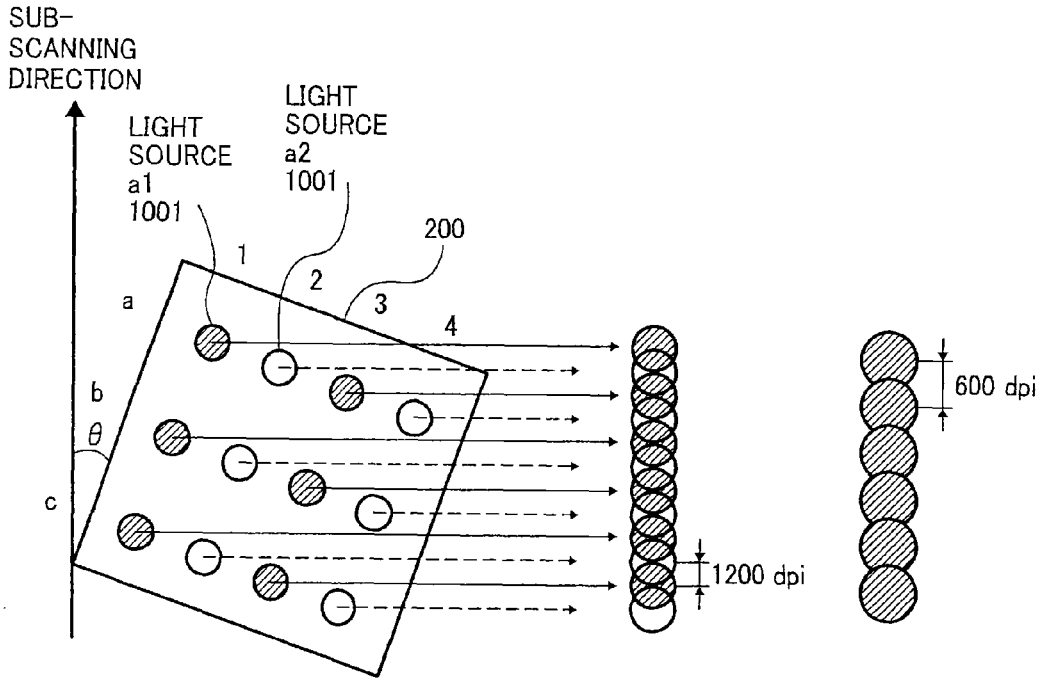
FIG. 2A is a configuration diagram of a VCSEL.

The VCSEL (Vertical Cavity Surface Emitting LASER) 200 here is a surface-emitting semiconductor laser in which a plurality of light sources (semiconductor lasers) are arranged on the same ship in a reticular pattern. Various technologies for an image forming apparatus using such a VCSEL 200 are known; the optical device 102 of the image forming apparatus 100 according to the present embodiment incorporates the VCSEL 200 in a configuration similar to those of the publicly-known technologies. FIG. 2A is a configuration diagram of the VCSEL 200 incorporated in the optical device 102 according to the present embodiment. The VCSEL 200 according to the present embodiment is, as shown in FIG. 2A, composed of a semiconductor laser array that a plurality of light sources 1001 (a plurality of semiconductor lasers) are arranged in a reticular pattern. The VCSEL 200 is provided so that an array direction of the plurality of light sources 1001 is tilted at a predetermined angle θ to a rotating shaft of the polygon mirror 102*a* as a deflector.

In FIG. 2A, vertical arrays of the light sources are denoted by a to c, and lateral arrays are denoted by 1 to 4; for example, the top-left light source 1001 in FIG. 2A is denoted by a1. Since the light sources 1001 are obliquely arranged at a polygon mirror angle θ with respect to a sub-scanning direction, it is assumed that the light source a1 and the light source a2 expose different scanning positions to light, and a pixel (one pixel) is constructed by this two light sources, i.e., in FIG. 2A, one pixel is achieved by two light sources. For example, when it is assumed that one pixel is constructed by the two light sources a1 and a2 and another one pixel is constructed by the two light sources a3 and a4, pixels as illustrated on the extreme right in FIG. 2A are formed by the light sources in the drawing. When the vertical direction in the drawing is set as the sub-scanning direction, a center-to-center distance between adjacent pixels each constructed by two light sources is equivalent to 600 dpi. At this time, a center-to-center distance between the two light sources constructing one pixel is equivalent to 1200 dpi, and the light-source density is twice as much as the pixel density. Therefore, by changing a light quantity ratio of light sources constructing one pixel, the position of the gravity center of the pixel can be displaced in the sub-scanning direction, and it is possible to achieve high-precision image formation.

Figure 2B:
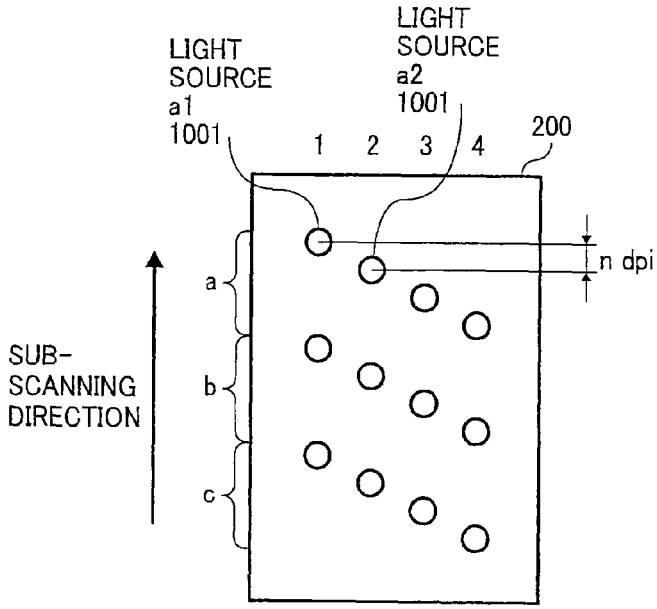
FIG. 2B is a configuration diagram of another example of a VCSEL.

FIG. 2B is a configuration diagram of another example of the VCSEL 200. In this example of the VCSEL 200, the light sources 1001 are arranged at the positions displaced in a sub-scanning direction. A center-to-center distance between the two light sources (n dpi in FIG. 2B) is equivalent to 2400 dpi, and is equivalent to 4800 dpi at a portion near the center thereof, which is an non-uniform arrangement. In the VCSEL 200 with the arrangement shown in FIG. 2B, the exposure is performed by means of an interlaced scanning.

In the embodiment shown in FIG. 1, light beams L respectively corresponding to cyan (C), magenta (M), yellow (Y), and black (K) image data are emitted, and reflected by the reflection mirrors 102*b*, and then again collected by second cylindrical lenses 102*c*, and after that, photosensitive drums 104*a*, 106*a*, 108*a*, and 110*a* are exposed to the light beams L, respectively.

Since the exposure of the light beams L is performed with use of a plurality of optical elements as described above, as for a main scanning direction and the sub-scanning direction, timing synchronization is performed. Incidentally, hereinafter, the main scanning direction is defined as a scanning direction of the light beams, and the sub-scanning direction is defined as a direction perpendicular to the main scanning direction.

Each of the photosensitive drums 104*a*, 106*a*, 108*a*, and 110*a* includes a photoconductive layer including at least a charge generation layer and a charge transport layer on a conductive drum made of aluminum or the like. The photoconductive layers are provided to correspond to the photosensitive drums 104*a*, 106*a*, 108*a*, and 110*a*, and applied with surface charges by charger units 104*b*, 106*b*, 108*b*, and 110*b* each including a corotron, a scorotron, or a charging roller, respectively.

Static charges applied to the photosensitive drums 104*a*, 106*a*, 108*a*, and 110*a* by the respective charger units 104*b*, 106*b*, 108*b*, and 110*b* are exposed to the light beams L, and electrostatic latent images are formed. The electrostatic latent images formed on the photosensitive drums 104*a*, 106*a*, 108*a*, and 110*a* are developed by developing units 104*c*, 106*c*, 108*c*, and 110*c* each including a developing sleeve, a developer supply roller, a control blade, and the like, respectively, and developer images are formed.

The developer images formed on the photosensitive drums 104*a*, 106*a*, 108*a*, and 110*a* are transferred onto an intermediate transfer belt 114, which moves in a direction of an arrow A in accordance with rotation of conveying rollers 114*a*, 114*b*, and 114*c*, in a superimposed manner. The superimposed C, M, Y, and K developer images (hereinafter, referred to as a "multicolor developer image") transferred onto the intermediate transfer belt 114 are conveyed to a secondary transfer unit in accordance with the movement of the intermediate transfer belt 114. The secondary transfer unit includes a secondary transfer belt 118 and conveying rollers 118*a* and 118*b*. The secondary transfer belt 118 moves in a direction of an arrow B in accordance with rotation of the conveying rollers 118*a* and 118*b*. An image receiving medium 124, such as high-quality paper or a plastic sheet, is fed from an image-receiving-media containing unit 128, such as a paper cassette, to the secondary transfer unit by a conveying roller 126.

The secondary transfer unit applies a secondary bias to the intermediate transfer belt 114, whereby the multicolor developer image on the intermediate transfer belt 114 is transferred onto the image receiving medium 124 attracted and held on the secondary transfer belt 118. The image receiving medium 124 is supplied to a fixing unit 120 in accordance with the movement of the secondary transfer belt 118. The fixing unit 120 includes a fixing member 130, such as a fixing roller made of silicon rubber or fluorine-contained rubber, and applies heat and pressure to the image receiving medium 124 and the multicolor developer image, and outputs the image receiving medium 124 as a printed material 132 to outside the image forming apparatus 100. After the multicolor developer image on the intermediate transfer belt 114 is transferred onto the image receiving medium 124, a cleaning unit 116 including a cleaning blade removes transfer residual developers from the intermediate transfer belt 114 to make ready for a next image forming process.

Figure 3:
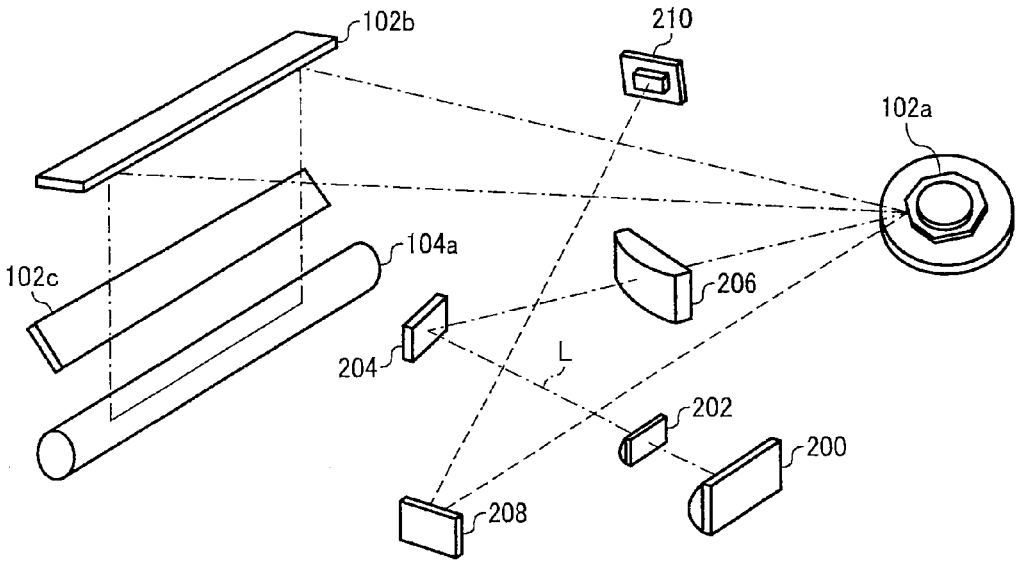
FIG. 3 is a schematic perspective view illustrating a case where an optical device including a VCSEL exposes a photosensitive drum to a light beam.

FIG. 3 is a schematic perspective view illustrating a case where the optical device 102 including the VCSEL 200 exposes the photosensitive drum 104*a* to light beams L. The light beams L emitted from the VCSEL 200 are collected by a first cylindrical lens 202 used to shape a light beam flux, and goes through a reflection mirror 204 and an imaging lens 206, and then is deflected by the polygon mirror 102*a*. The polygon mirror 102*a* is driven to spin several thousand times to tens of thousands times by a spindle motor or the like. After the light beam L reflected by the polygon mirror 102*a* is reflected by the reflection mirror 102*b*, the light beam L passes through fθ lens (not shown) and is again shaped by the second cylindrical lens 102*c*, then hits the photosensitive drum 104*a*, i.e., the photosensitive drum 104*a* is exposed to the light beam L.

Furthermore, to synchronize a start timing of scanning in the sub-scanning direction by the light beam L, a reflection mirror 208 is arranged. The reflection mirror 208 reflects the light beam L to a synchronization detection device 210 including a photodiode and the like before the scanning in the sub-scanning direction is started. When detecting the light beam, the synchronization detection device 210 generates a synchronization signal to start sub-scanning, and synchronizes a process, such as a process of generating a drive control signal to the VCSEL 200.

The VCSEL 200 is driven by a pulse signal sent from a write control unit 310 to be described later, and as described later, the position of the photosensitive drum 104*a* corresponding to predetermined image bits of image data is exposed to the light beam L, and an electrostatic latent image is formed on the photosensitive drum 104*a*.

Figure 4:
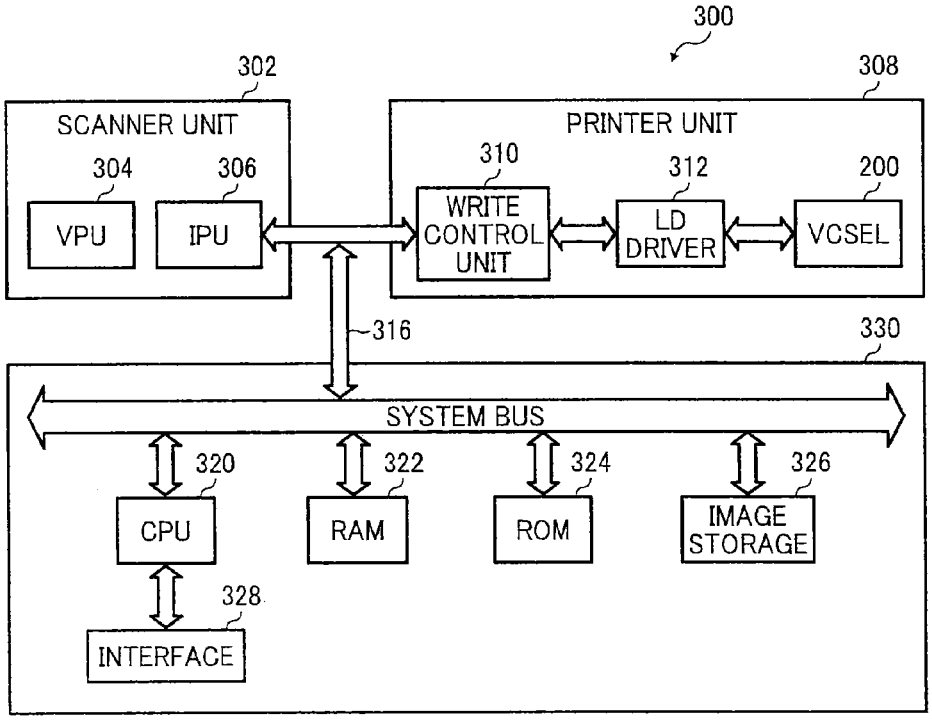
FIG. 4 is a schematic functional block diagram of a control unit of the image forming apparatus.

FIG. 4 is a schematic functional block diagram of a control unit 300 of the image forming apparatus 100. The control unit 300 includes a scanner unit 302, a printer unit 308, and a main control unit 330. The scanner unit 302 functions as a means for reading an image, and includes a VPU 304 and an IPU 306. The VPU 304 converts an analog signal read by a scanner into a digital signal, and performs a black offset correction, a shading correction, and a pixel location correction. The IPU 306 performs image processing mainly for converting the acquired image in the RGB color system into digital image data in the CMYK color system. The read image acquired by the scanner unit 302 is output as digital data to the printer unit 308.

The printer unit 308 includes the write control unit 310, an LD driver 312, and the VCSEL 200. The write control unit 310 functions as a control means for performing the drive control of the VCSEL 200. The LD driver 312 supplies a current for driving a semiconductor laser element to the semiconductor laser element in response to a drive control signal generated by the write control unit 310. The VCSEL 200 mounts thereon two-dimensionally-arranged semiconductor laser elements. The write control unit 310 according to the present embodiment executes high-resolution processing on the image data transmitted from the scanner unit 302 by dividing pixel data in a size corresponding to the spatial size of the semiconductor laser elements of the VCSEL 200.

The scanner unit 302 and the printer unit 308 are connected to the main control unit 330 via a system bus 316, and image reading and image formation are controlled by a command from the main control unit 330. The main control unit 330 includes a central processing unit (CPU) 320 and a RAM 322. The RAM 322 provides a processing space used by the CPU 320 for processing. Any CPUs that have been known can be used as the CPU 320; for example, a CISC (Complex Instruction Set Computer), such as the PENTIUM (registered trademark) series and a PENTIUM-compatible CPU, a RISK (Reduced Instruction Set Computer), such as the MIPS, and the like can be used. The CPU 320 receives an instruction from a user via an interface 328, and calls a program module for executing a process corresponding to the instruction to execute the process, such as copy, fax, scan, or image storage. The main control unit 330 further includes a ROM 324, and the ROM 324 stores therein default setting data of the CPU 320, control data, a program, and the like so as to be used by the CPU 320. An image storage 326 is configured as a fixed memory device or removable memory device, such as a hard disk device, an SD card, and a USB memory, and stores therein image data acquired by the image forming apparatus 100 so that the image data can be used for various processes by a user.

When an image of image data acquired by the scanner unit 302 is output as an electrostatic latent image on the photosensitive drum 104*a* or the like by driving the printer unit 308, the CPU 320 executes the main scanning direction control and the sub-scanning position control of an image receiving medium, such as high-quality paper or a plastic film. To start scanning in the sub-scanning direction, the CPU 320 outputs a start signal to the write control unit 310. When the write control unit 310 receives the start signal, the IPU 306 starts a scanning process. After that, the write control unit 310 receives image data stored in a buffer memory or the like, and processes the received image data, and then outputs the processed image data to the LD driver 312. When receiving the image data from the write control unit 310, the LD driver 312 generates a drive control signal of the VCSEL 200. After that, the LD driver 312 sends the drive control signal to the VCSEL 200, thereby lighting up the VCSEL 200. Incidentally, the LD driver 312 drives the semiconductor laser elements by the use of the PWM control or the like. The VCSEL 200 explained in the present embodiment includes 8 channels of semiconductor laser elements; however, the number of channels of the VCSEL 200 is not limited thereto.

Figure 11:
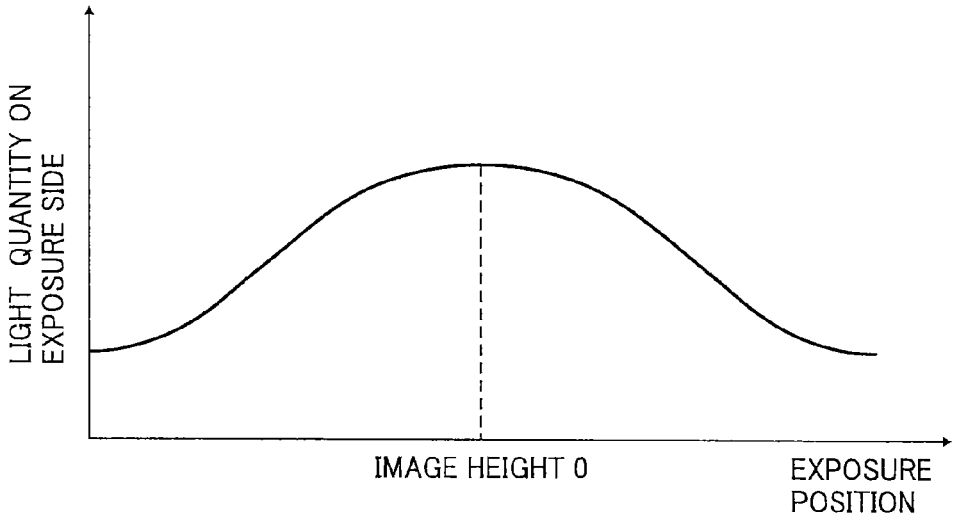
FIG. 11 is a diagram illustrating a shading correction curve.
Figure 12:
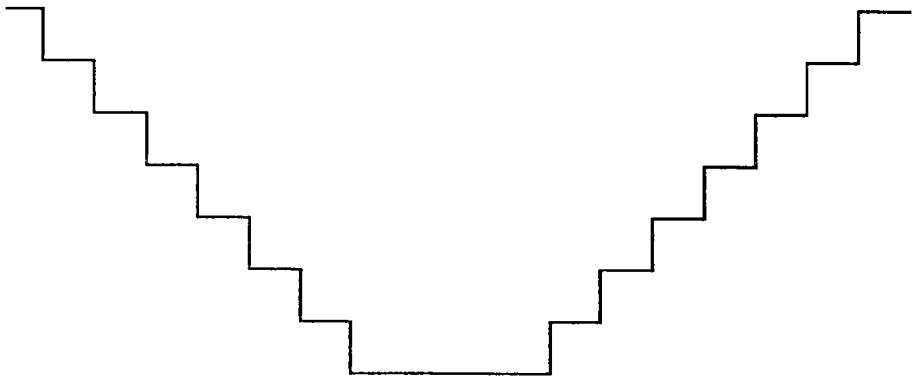
FIG. 12 is a diagram illustrating a condition of a stair-like shading correction curve.

Laser beams onto a photoreceptor are attenuated by passing through lenses and the like, and affected by characteristics of the lenses, so that even if the laser beams are constant in light quantity at the light-source outlets, a light intensity differs among the laser beams depending on the main scanning position. If an image height on the middle of the photoreceptor is set as 0, for example, a light-quantity distribution as shown in FIG. 11 is obtained. It shows that to implement a light-quantity correction of the light-quantity distribution shown in FIG. 11 so as to be identical to a light quantity at the image height of 0 in a whole image height, a light quantity at an image-height end portion is increased, and the light quantity is controlled not to be increased gradually as the image height approaches 0.

Figure 5:
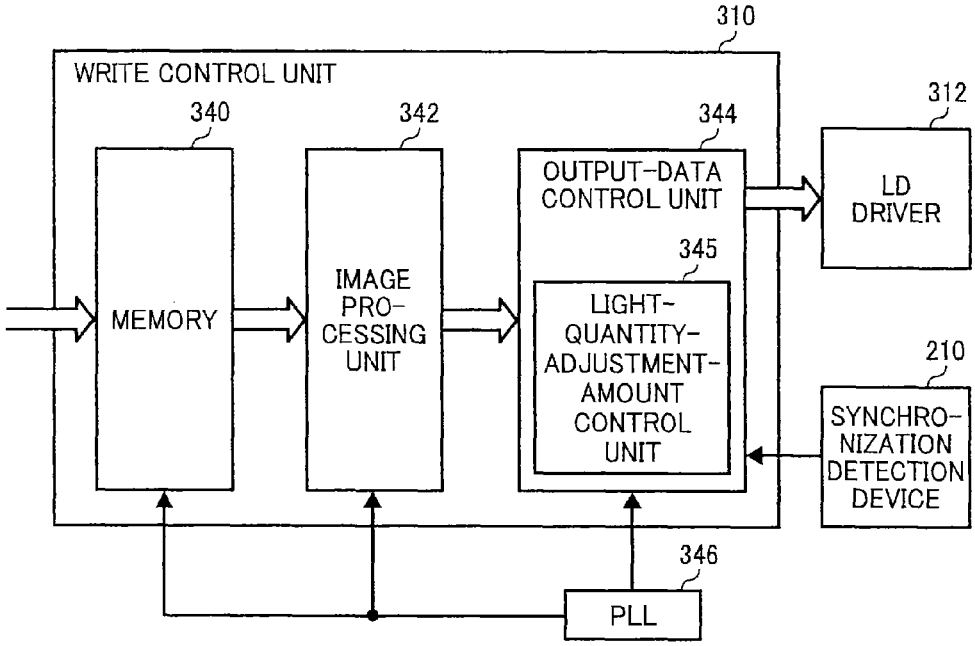
FIG. 5 is a detailed functional block diagram of a write control unit.

In the present embodiment, such an adjustment of light quantity is performed as follows. FIG. 5 is a detailed functional block diagram of the write control unit 310. The write control unit 310 receives a synchronization signal, and includes a memory 340 such as a FIFO buffer for storing and memorizing image data sent from the IPU 306, and passes the image data sent from the IPU 306 to an image processing unit 342 via the memory 340. The image processing unit 342 reads the image data from the memory 340, and executes processes of a resolution conversion of the image data, an allocation of the channel of the semiconductor laser element, and addition/deletion of image bits (i.e., corrected pixel for enlargement/reduction of the image data) (i.e., a correction process of the image data). The position of the photosensitive drum 104*a* exposed to light beams corresponding to the image data is defined by a main-scanning line address value defining the main scanning direction and a sub-scanning line address value defining the sub-scanning direction.

An output-data control unit 344 adjusts light quantity of the VCSEL 200, and sends a drive control signal of the VCSEL 200 to the LD driver 312. The output-data control unit 344 includes a light-quantity-adjustment-amount control unit 345 for controlling the adjustment of light quantity of the VCSEL 200 by the LD driver 312. In other words, the light-quantity-adjustment-amount control unit 345 controls a light-quantity adjustment amount for the LD driver 312 to adjust a quantity of light emitted from the VCSEL 200.

Figure 6:
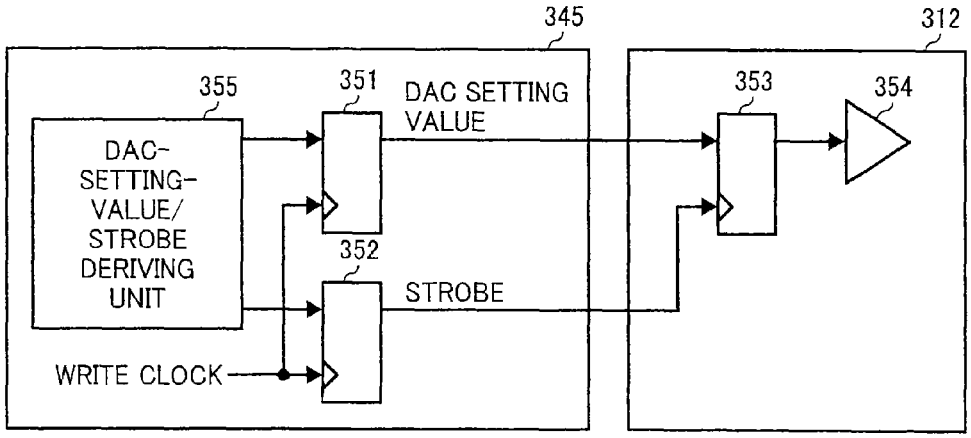
FIG. 6 is an explanatory diagram of detailed configurations of a light-quantity-adjustment-amount control unit 345 and an LD driver.

FIG. 6 is an explanatory diagram of detailed configurations of interfaces of the light-quantity-adjustment-amount control unit 345 and the LD driver 312. The light-quantity-adjustment-amount control unit 345 is provided with a DAC-setting-value/strobe deriving unit 355 and flip-flop circuits 351 and 352. The LD driver 312 is provided with a flip-flop circuit 353 and a shading correction DAC (D/A converter) 354.

Figure 7:
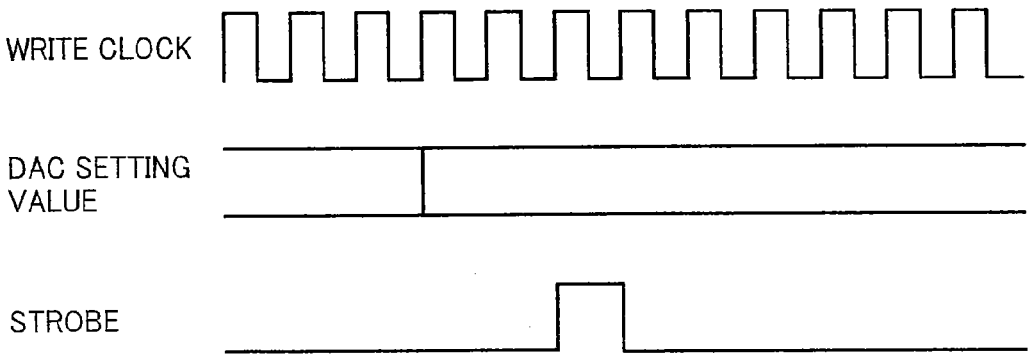
FIG. 7 is a diagram illustrating output timings of a write clock, a DAC setting value, and a strobe.

The DAC-setting-value/strobe deriving unit 355 of the light-quantity-adjustment-amount control unit 345 derives a DAC setting value and a strobe, outputs the DAC setting value to the flip-flop circuit 351, and outputs the strobe to the flip-flop circuit 352. A write clock is input to the flip-flop circuits 351 and 352 of the light-quantity-adjustment-amount control unit 345, and the DAC setting value is output as a light-quantity adjustment amount from the flip-flop circuit 351 to the LD driver 312. Furthermore, the strobe is output from the flip-flop circuit 352 to the LD driver 312. Output timings of the write clock, the DAC setting value, and the strobe are as shown in FIG. 7. The timings are set as shown in FIG. 7 to give a margin to a setup timing of the flip-flop circuit 353 of the LD driver 312.

The DAC setting value and the strobe are input to the flip-flop circuit 353 of the LD driver 312, and the DAC setting value is set in the shading correction DAC 354, and an adjustment of light quantity is performed by the DAC 354.

Figure 8:
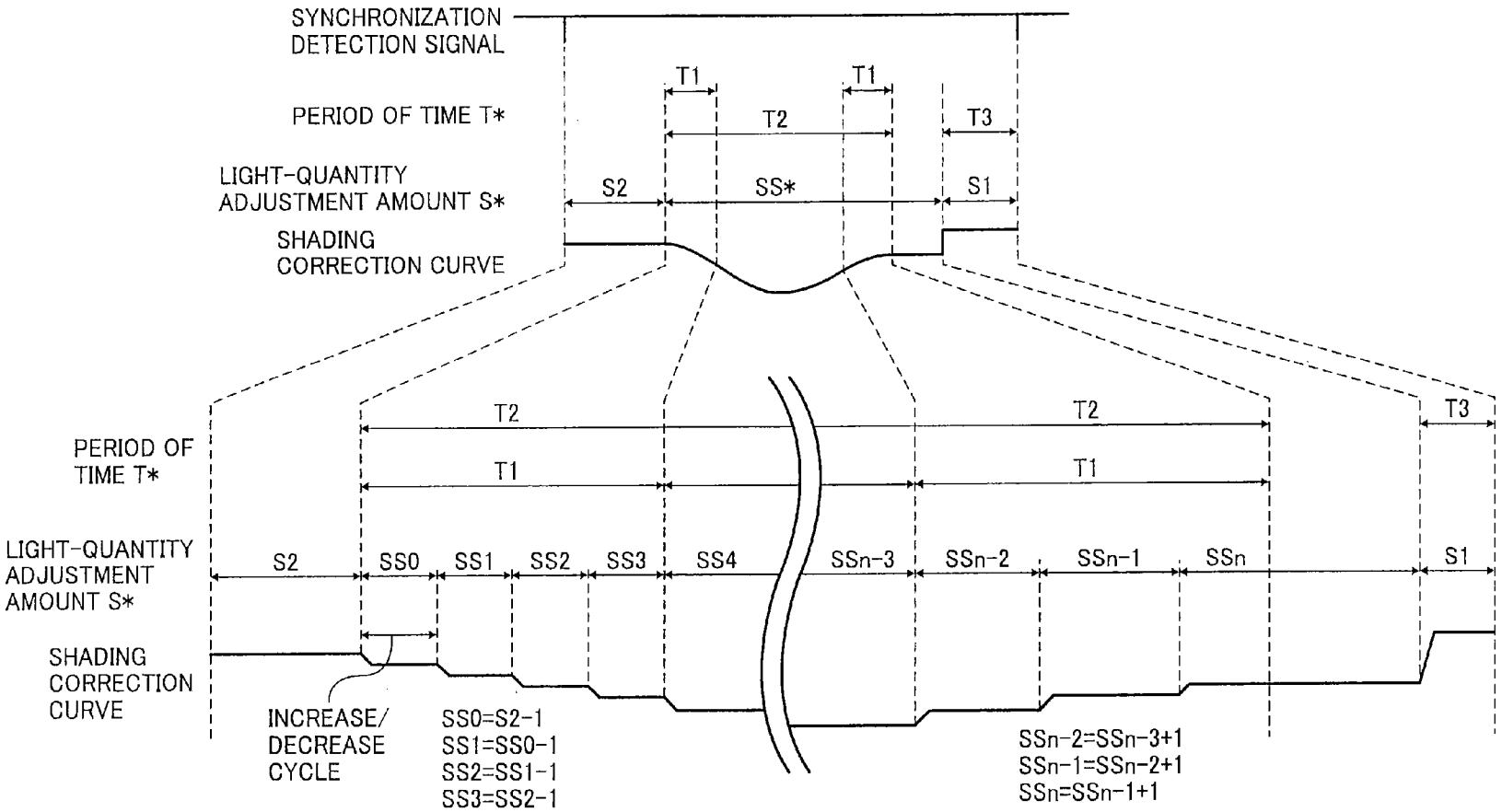
FIG. 8 is a diagram illustrating a light-quantity adjustment amount output from the light-quantity-adjustment-amount control unit 345 according to a first embodiment and a shading correction curve.

FIG. 8 is a diagram illustrating a light-quantity adjustment amount output from the light-quantity-adjustment-amount control unit 345 according to the first embodiment and a shading correction curve.

As shown in FIG. 8, the light-quantity-adjustment-amount control unit 345 performs a shading correction (an adjustment of light quantity) based on a timing signal obtained by synchronization detection. Since a light quantity for performing the synchronization detection needs to be a quantity of light required for a photoelectric conversion element to react the light, the light-quantity-adjustment-amount control unit 345 outputs a light-quantity adjustment amount S1 in a period of time T3 before the synchronization detection timing.

Furthermore, to achieve good image formation, it is necessary to perform a shading correction in a period of time T2, which is a period during which an electrostatic latent image is formed; thus, the light-quantity-adjustment-amount control unit 345 outputs a light-quantity adjustment amount S2 required at the start of the shading correction from when the synchronization detection is completed until formation of an electrostatic latent image is started.

As shown in FIG. 8, the period of time T2 is divided into a plurality of different time periods T1, and when it comes to the first time period T1, the light-quantity-adjustment-amount control unit 345 repeatedly outputs a light-quantity adjustment amount in accordance with a multiple (a positive integer equal to or greater than 2) of a write clock cycle (not shown). Herein, the time period T1 denotes a time period during which the light-quantity adjustment amount increases or decreases.

In the example shown in FIG. 8, the light-quantity-adjustment-amount control unit 345 decreases light-quantity adjustment amounts SS0 to SS3 output during the first time period T1. Consequently, the corrected light quantity corrected based on the light-quantity adjustment amount gradually falls by 0.1% to 0.13%.

In the present embodiment, the light-quantity-adjustment-amount control unit 345 changes the shading correction curve by further adjusting a length of each increase/decrease cycle which is a unit of time in relation to an increase or decrease in the light-quantity adjustment amount within the time period T1 during which the light-quantity adjustment amount increases or decreases (i.e., each period during which the light-quantity adjustment amounts SS0, SS1, SS2, . . . , and SSn−1 are output), or a length of the time period T1, thereby smoothing a curve representing an increase and decrease in the light-quantity adjustment amount, i.e., an increase and decrease in a quantity of light emitted from the VCSEL 200. The adjustment of the length of the increase/decrease cycle of the light-quantity adjustment amount or the length of the time period T1 is set by the light-quantity-adjustment-amount control unit 345 in advance; alternatively, the adjustment can be made by an instruction from a user or the like.

In the last time period T1 in the period of time T2, the light-quantity-adjustment-amount control unit 345 increases light-quantity adjustment amounts SSn−2 to SSn. Consequently, the corrected light quantity gradually rises by 0.1% to 0.13%.

After a lapse of the last time period T1, the light-quantity-adjustment-amount control unit 345 continues to output the last light-quantity adjustment amount SSn until it comes to the period of time T3. Incidentally, if the period of time T3 overlaps into the period of time T2, the light-quantity-adjustment-amount control unit 345 outputs the light-quantity adjustment amount S1 from the point of time when it comes to the period of time T3.

In this manner, in the present embodiment, the shading correction curve is changed by adjusting the length of the increase/decrease cycle of the light-quantity adjustment amount in the time period T1 or the length of the time period T1 thereby smoothing a curve representing increase and decrease in the light-quantity adjustment amount, and thus it is possible to obtain a high-quality image reduced in density fluctuation by performing the smooth shading correction in accordance with optical characteristics without increasing the apparatus configuration excessively.

Second Embodiment

In the first embodiment, the shading correction curve is changed by adjusting the length of the increase/decrease cycle of the light-quantity adjustment amount in the time period T1 or the length of the time period T1. In a second embodiment, a shading correction curve is smoothed by specifying the number of increases in light-quantity adjustment amount and the number of decreases in light-quantity adjustment amount. The adjustment of the numbers of increases and decreases in the light-quantity adjustment amount is set by the light-quantity-adjustment-amount control unit 345 in advance; alternatively, the adjustment can be made by an instruction from a user or the like.

Figure 9:
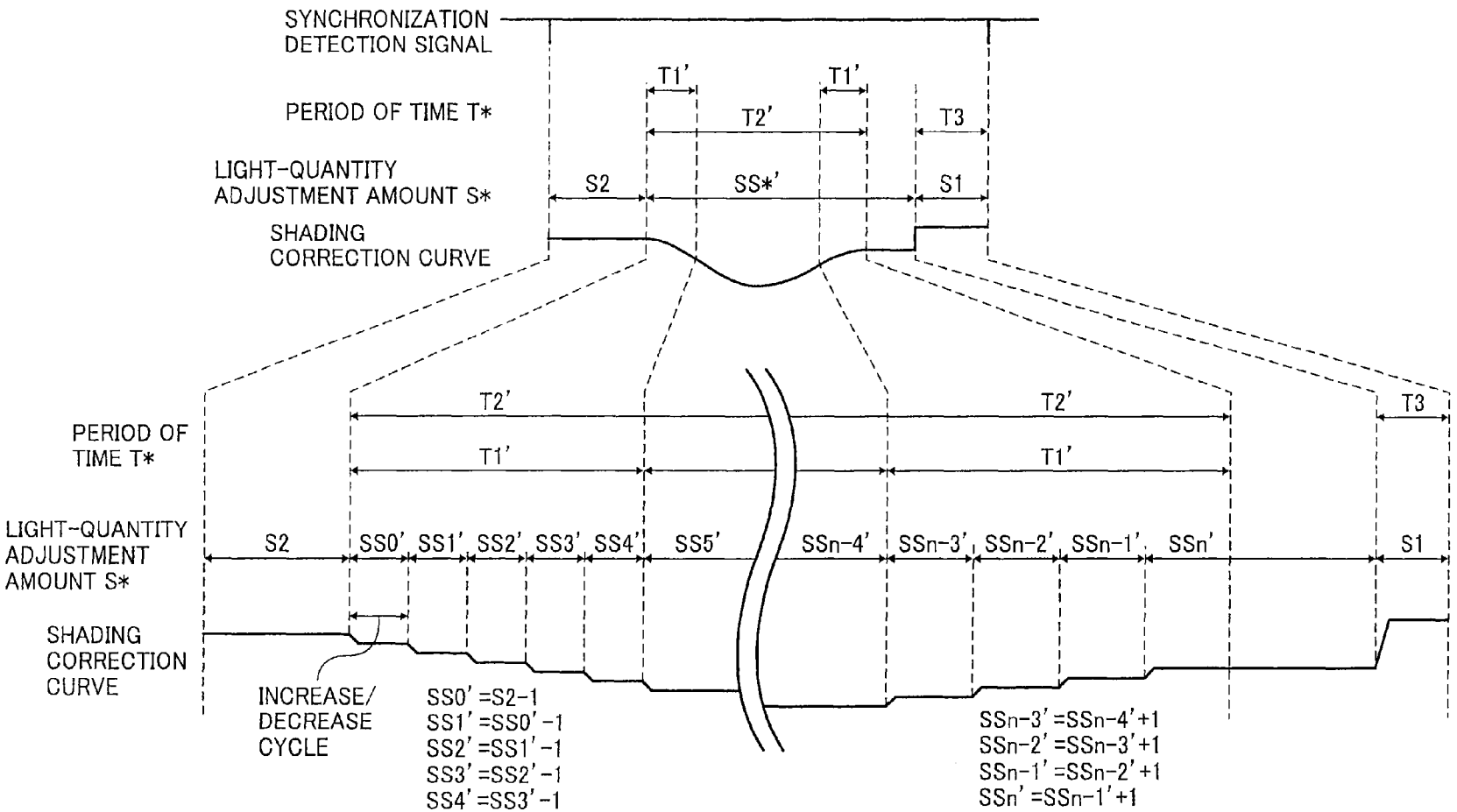
FIG. 9 is a diagram illustrating a light-quantity adjustment amount output from the light-quantity-adjustment-amount control unit 345 according to a second embodiment and a shading correction curve.

FIG. 9 is a diagram illustrating a light-quantity adjustment amount output from the light-quantity-adjustment-amount control unit 345 according to the second embodiment and a shading correction curve.

Configurations of units in an image forming apparatus according to the present embodiment are identical to those shown in FIGS. 1 to 5.

As shown in FIG. 9, a period of time T2' is divided into a plurality of different time periods T1', and when it comes to the first time period T1', the light-quantity-adjustment-amount control unit 345 repeatedly outputs a light-quantity adjustment amount in accordance with a multiple (a positive integer equal to or greater than 2) of a write clock cycle (not shown).

In the example shown in FIG. 9, in the first time period T1' in the time period T2', the number of decreases in the light-quantity adjustment amount is set to five. The light-quantity-adjustment-amount control unit 345 decreases light-quantity adjustment amounts SS0' to SS4' output in the first time period T1'; consequently, the corrected light quantity gradually falls by 0.1% to 0.13%.

In the last time period T1' in the period of time T2', the number of increases in the light-quantity adjustment amount is set to four. The light-quantity-adjustment-amount control unit 345 increases light-quantity adjustment amounts SSn−3' to SSn' in the last time period T1' in the time period T2'; consequently, the corrected light quantity gradually rises by 0.1% to 0.13%.

After a lapse of the last time period T1', the light-quantity-adjustment-amount control unit 345 continues to output the last light-quantity adjustment amount SSn' until it comes to the period of time T3.

Incidentally, if the period of time T3 overlaps into the period of time T2', the light-quantity-adjustment-amount control unit 345 outputs the light-quantity adjustment amount S1 from the point of time when it comes to the period of time T3.

In the present embodiment, the light-quantity-adjustment-amount control unit 345 adjusts the numbers of increases and decreases in the light-quantity adjustment amount in the time periods T1', thereby smoothing the shading correction curve. In other words, the increase/decrease cycle of the light-quantity adjustment amount is determined by setting the numbers of increases and decreases in the light-quantity adjustment amount in the time periods T1', and if the time period T1' cannot be divided evenly by the number of increases or decreases, a length of a cycle of the last light-quantity adjustment amount in the time period T1' (for example, SS4' in FIG. 9) is extended or shortened.

In this manner, in the present embodiment, the shading correction curve is smoothed by specifying the number of increases and the number of decreases in the light-quantity adjustment amount, and thus it is possible to obtain a high-quality image reduced in density fluctuation by performing the smooth shading correction in accordance with optical characteristics without increasing the apparatus configuration excessively.

(Modification)

Figure 10A:
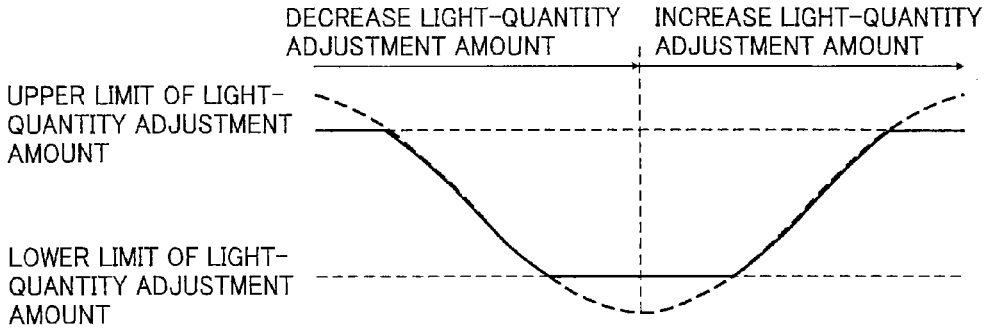
FIGS. 10A, 10B and 10C are diagrams illustrating a result of the shading correction.
Figure 10B:
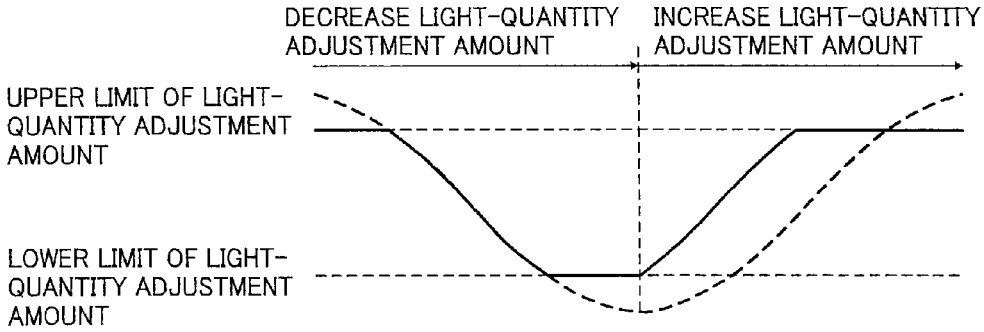
Figure 10C:
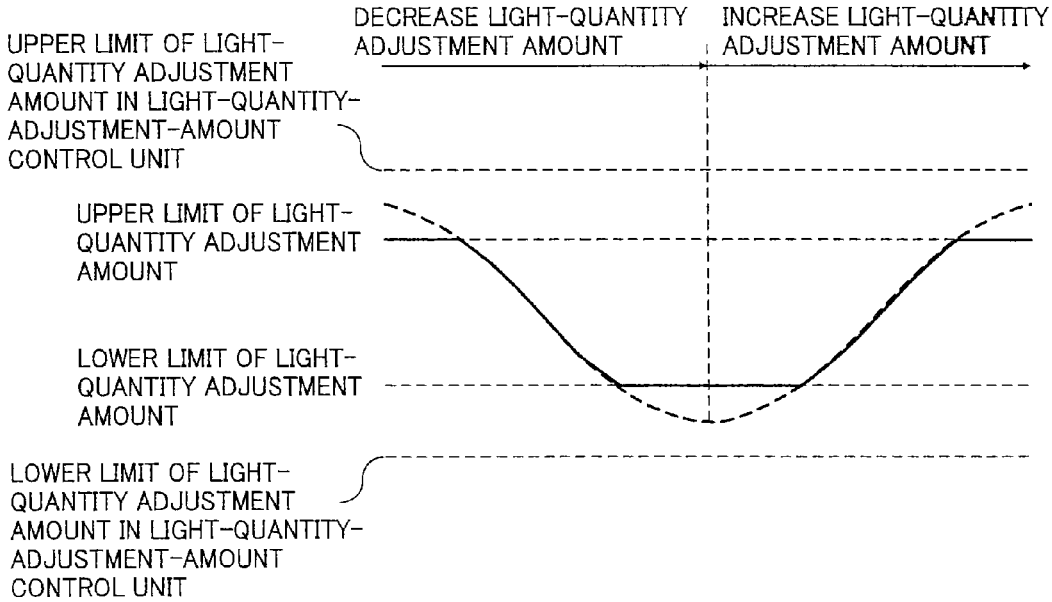

In a case where an upper limit to a lower limit of a light-quantity adjustment amount, i.e., a limit of resolution in the light-quantity-adjustment-amount control unit 345 is identical to that of the LD driver 312, when a shading correction shown on the top of FIG. 10 is to be executed, if a process shown on the middle of FIG. 10 is performed, it is not possible to obtain a desired result. Thus, in a present modification, as shown on the bottom of FIG. 10, it is configured that a range of the upper limit to the lower limit of the light-quantity adjustment amount in the light-quantity-adjustment-amount control unit 345 is set to be wider than a range of the light quantity of the LD driver 312. Consequently, it is possible to execute a desired shading correction as shown on the top of FIG. 10.

According to the present invention, an adjustment of light quantity in accordance with a shading correction curve is performed by controlling, for a light-source drive unit, a light-quantity adjustment amount and a length of an increase/decrease cycle of the light-quantity adjustment amount that is a unit of time in relation to an increase or decrease in the light-quantity adjustment amount, and thus it is possible to obtain a high-quality image reduced in density fluctuation by performing a smooth shading correction in accordance with optical characteristics without increasing an apparatus configuration excessively.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus that performs a shading correction, the image forming apparatus comprising:

a light source that emits a light beam;

a light-source drive unit that drives the light source; and a light-quantity-adjustment-amount control unit that performs an adjustment of a light quantity in accordance with a shading correction curve by controlling, for the light-source drive unit, a light-quantity adjustment amount and an increase/decrease cycle of the light-quantity adjustment amount, the increase/decrease cycle being a unit of time within a time period during which the light-quantity adjustment amount increases or decreases, wherein the light-quantity-adjustment-amount control unit performs the adjustment of the light quantity by adjusting a length of the increase/decrease cycle or a length of the time period itself in the time period during the light-quantity adjustment amount increases or decreases.

2. The image forming apparatus according to claim 1, wherein the light-quantity-adjustment-amount control unit adjusts the light-quantity adjustment amount within a range from a minimum value to a maximum value of the light-quantity adjustment amount of the light-source drive unit.

3. The image forming apparatus according to claim 1, wherein the light-quantity-adjustment-amount control unit adjusts the increase/decrease cycle of the light-quantity adjustment amount to a multiple of an image write clock cycle, which is a positive integer equal to or greater than 2.

4. The image forming apparatus according to claim 1, wherein the light-quantity adjustment amount is set to a predetermined value in a period before the light beam is detected.

5. An image forming method implemented by an image forming apparatus that includes a light source for emitting a light beam and performs a shading correction, the image forming method comprising:

driving the light source; and adjusting a light quantity in accordance with a shading correction curve by controlling a light-quantity adjustment amount and an increase/decrease cycle of the light-quantity adjustment amount, the increase/decrease cycle being a unit of time within a time period during which the light-quantity adjustment amount increases or decreases, wherein adjusting the light quantity comprises adjusting a length of the increase/decrease cycle or a length of the time period itself in the time period during the light-quantity adjustment amount increases or decreases.

6. An image forming apparatus that performs a shading correction, the image forming apparatus comprising:

a light source that emits a light beam;

a light-source drive unit that drives the light source; and a light-quantity-adjustment-amount control unit that performs respective light quantity adjustments across a plurality of time periods in accordance with a shading correction curve by controlling, for the light-source drive unit, the respective light-quantity adjustments for each time period and increase/decrease cycles inside each of the time periods, wherein, over a duration of the increase/decrease cycles inside each of the time periods, a fraction of the light-quantity adjustment for each respective time period increases or decreases.

7. An image forming method implemented by an image forming apparatus that includes a light source for emitting a light beam and performs a shading correction, the image forming method comprising:

driving the light source; and adjusting in accordance with a shading correction curve respective light quantity adjustments across a plurality of time periods by controlling 1) the respective light-quantity adjustments for each time period and 2) increase/decrease cycles inside each of the time periods, wherein, over a duration of the increase/decrease cycles inside each of the time periods, a fraction of the light-quantity adjustment for each respective time period increases or decreases.

* * * * *